US012540046B2

(12) United States Patent
Mizuguchi et al.

(10) Patent No.: US 12,540,046 B2
(45) Date of Patent: Feb. 3, 2026

(54) SHEET FEEDER CAPABLE OF PULLING OUT AND FEEDING SHEET FROM MULTI-PURPOSE TRAY, AND IMAGE FORMING APPARATUS

(71) Applicant: KYOCERA Document Solutions Inc., Osaka (JP)

(72) Inventors: Keisuke Mizuguchi, Osaka (JP); Kei Wakayama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 14 days.

(21) Appl. No.: 18/739,546

(22) Filed: Jun. 11, 2024

(65) Prior Publication Data

US 2024/0425312 A1 Dec. 26, 2024

(30) Foreign Application Priority Data

Jun. 20, 2023 (JP) ..... 2023-101179

(51) Int. Cl.
*B65H 3/06* (2006.01)

(52) U.S. Cl.
CPC ..... *B65H 3/0684* (2013.01); *B65H 2404/152* (2013.01); *B65H 2405/10* (2013.01); *B65H 2801/06* (2013.01)

(58) Field of Classification Search
CPC ..... B65H 85/00; B65H 29/20; B65H 29/00; B65H 3/068
See application file for complete search history.

(56) References Cited

U.S. PATENT DOCUMENTS

| | | | | |
|---|---|---|---|---|
| 7,909,318 | B2 * | 3/2011 | Kim | B65H 3/5223 271/9.13 |
| 9,533,849 | B2 * | 1/2017 | Kasaishi | B65H 5/36 |
| 9,975,717 | B2 * | 5/2018 | Fujinuma | B65H 1/04 |
| 2023/0062086 | A1 * | 3/2023 | Liao | B65H 9/002 |

FOREIGN PATENT DOCUMENTS

JP 2018203479 A 12/2018

* cited by examiner

*Primary Examiner* — Patrick Cicchino
(74) *Attorney, Agent, or Firm* — IP Business Solutions, LLC.

(57) ABSTRACT

A sheet feeder includes: a multi-purpose tray; a guide roller provided at an end of the multi-purpose tray to come into contact a recording paper sheet protruding from the end of the multi-purpose tray; a spring member that supports the guide roller elastically and movably in upward and downward directions; and a pick-up roller that is disposed apart from the end of the multi-purpose tray movably in the upward and downward directions and, when moved downward, pulls out the recording paper sheet protruding across an upper side of a peripheral surface of the guide roller from the end of the multi-purpose tray while being pressed against a leading end portion of the recording paper sheet.

6 Claims, 8 Drawing Sheets

SHEET FEEDER CAPABLE OF PULLING OUT AND FEEDING SHEET FROM MULTI-PURPOSE TRAY, AND IMAGE FORMING APPARATUS

INCORPORATION BY REFERENCE

This application claims priority to Japanese Patent Application No. 2023-101179 filed on Jun. 20, 2023, the entire contents of which are incorporated by reference herein.

BACKGROUND

The present disclosure relates to sheet feeders capable of pulling out and feeding a sheet from a multi-purpose tray or a sheet supply cassette and image forming apparatuses including the sheet feeders and particularly relates to a technique for reducing the load on a pick-up roller in pulling out a sheet from the multi-purpose tray.

An image forming apparatus is an apparatus that forms an image on a recording paper sheet and includes a sheet supply cassette capable of supplying recording paper sheets or a multi-purpose tray for manual feed of a recording paper sheet. The multi-purpose tray is provided in the interior of the apparatus body. When a recording paper sheet is manually placed on the multi-purpose tray, a pick-up roller pulls out and feeds the recording paper sheet from the multi-purpose tray.

There is known a sheet conveying device in which a manual feed unit is mounted over a sheet supply cassette, a manual feed conveyance path for use in conveying a sheet pulled out from the manual feed unit is merged downstream with a cassette conveyance path for use in conveying a sheet pulled out from the sheet supply cassette, and the sheet in the cassette is pulled out by a sheet feed unit provided in the cassette conveyance path. Furthermore, this sheet conveying device is designed to allow a conveyance roller provided at the manual feed unit to convey a sheet from the manual feed conveyance path to the cassette conveyance path, then stop the conveyance roller based on detection of a leading end of the sheet by a leading-end detecting device disposed between the conveyance roller and the sheet feed unit, move the leading end of the sheet before the sheet feed unit, allow the conveyance roller to convey the sheet again, and allow the sheet feed unit to pull out the sheet from the manual feed unit.

SUMMARY

A technique improved over the aforementioned techniques is proposed as one aspect of the present disclosure.

A sheet feeder according to an aspect of the present disclosure includes a sheet supply cassette, a multi-purpose tray, a guide roller, an elastic support member, and a pick-up roller. The sheet supply cassette supplies a sheet accommodated therein. The multi-purpose tray is provided above the sheet supply cassette and receives a sheet for manual feed placed thereon. The guide roller is provided at an end of the multi-purpose tray to come into contact with the sheet protruding from the end of the multi-purpose tray. The elastic support member is provided at the end of the multi-purpose tray and supports the guide roller elastically and movably in directions toward and away from the sheet supply cassette. The pick-up roller is disposed apart from the end of the multi-purpose tray movably in the directions toward and away from the sheet supply cassette and, when moved toward the sheet supply cassette, the pick-up roller pulls out the sheet protruding across an upper side of a peripheral surface of the guide roller from the end of the multi-purpose tray while being pressed against a leading end portion of the sheet. A position of the pick-up roller to be pressed against the leading end portion of the sheet is located closer to the sheet supply cassette than the upper side of the peripheral surface of the guide roller.

An image forming apparatus according to another aspect of the present disclosure includes: the sheet feeder according to the one aspect of the present disclosure; and an image forming device that forms an image on a sheet pulled out and fed from the multi-purpose tray or the sheet supply cassette of the sheet feeder.

DETAILED DESCRIPTION

Figure 1A:
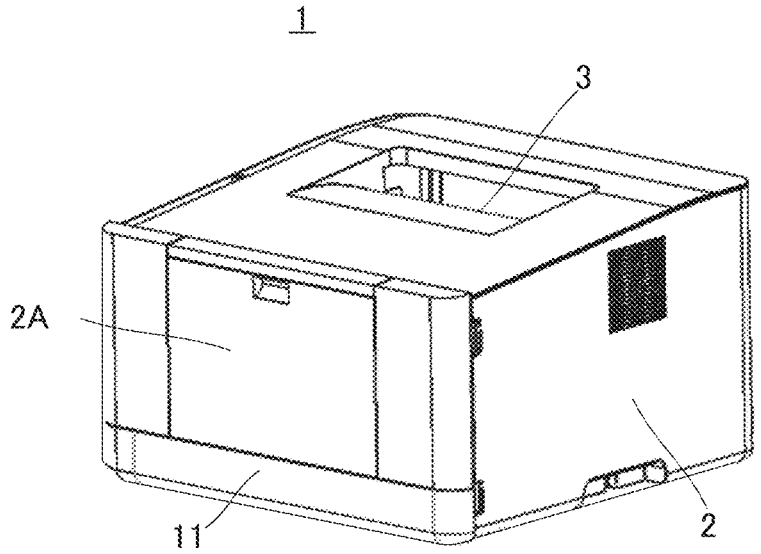
FIG. 1A is a perspective view showing the appearance of an image forming apparatus to which a sheet feeder according to one embodiment of the present disclosure is applied, and shows a state where a sidewall of an apparatus body is closed.
Figure 1B:
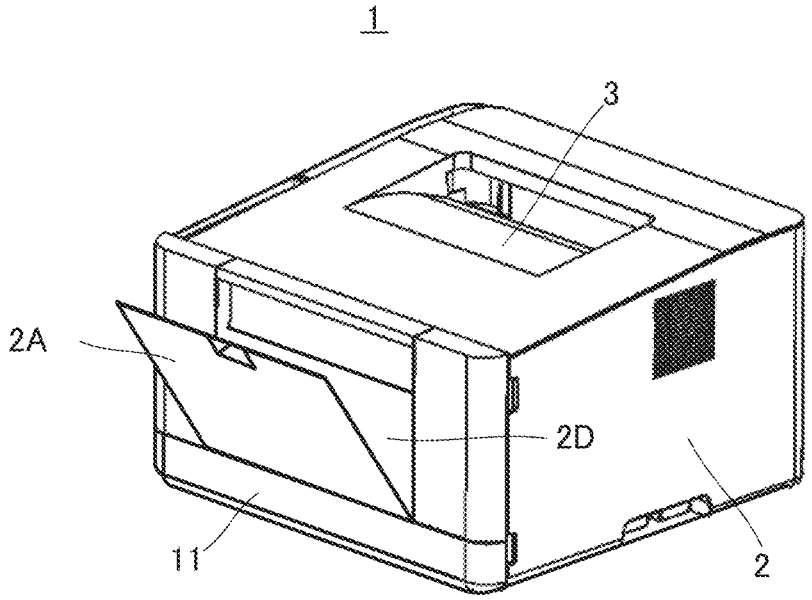
FIG. 1B is a perspective view showing the appearance of the image forming apparatus to which the sheet feeder according to the one embodiment of the present disclosure is applied, and shows a state where the sidewall of the apparatus body is halfway open.
Figure 2:
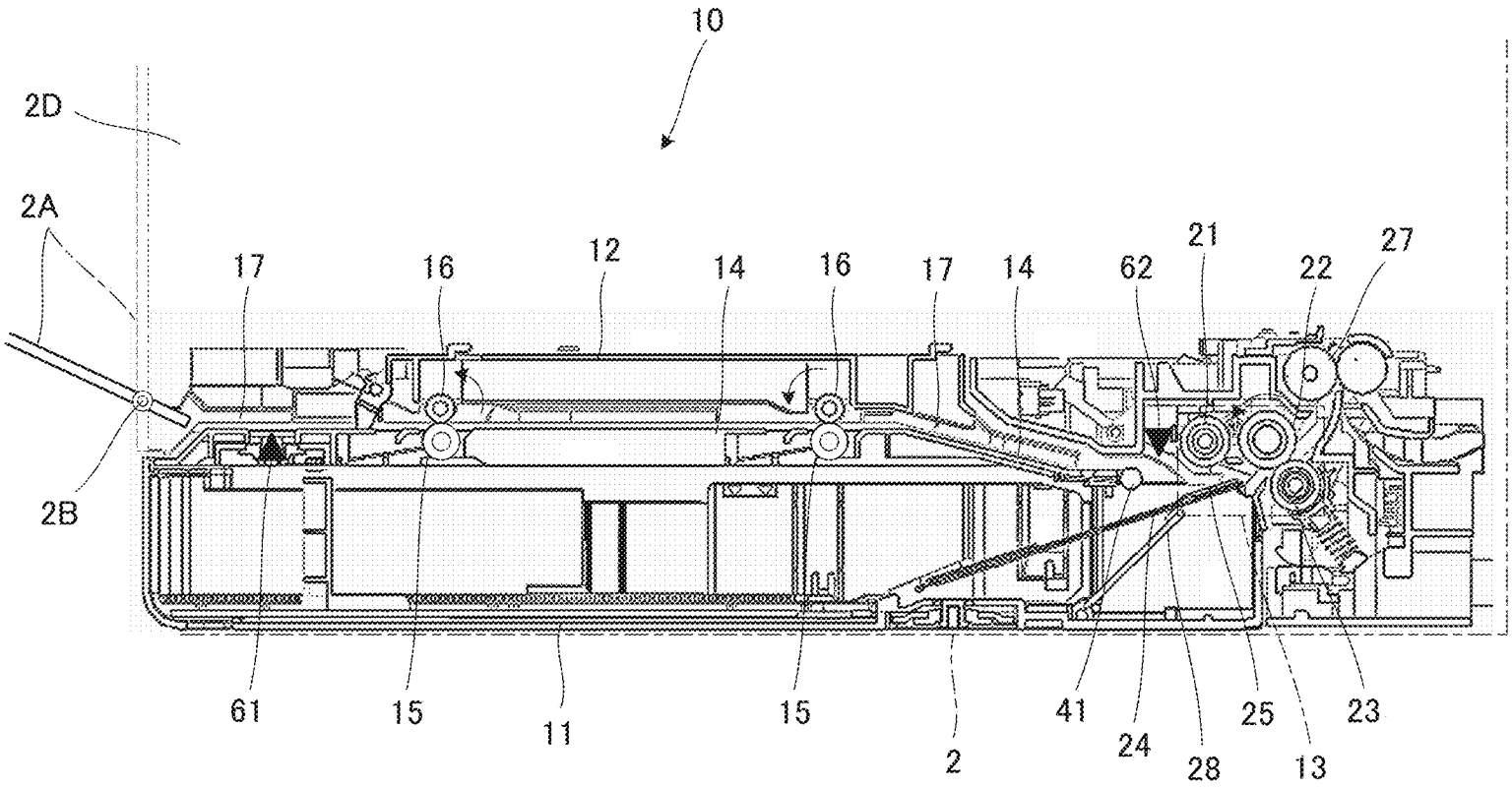
FIG. 2 is a cross-sectional view of the sheet feeder according to the one embodiment.
Figure 3:
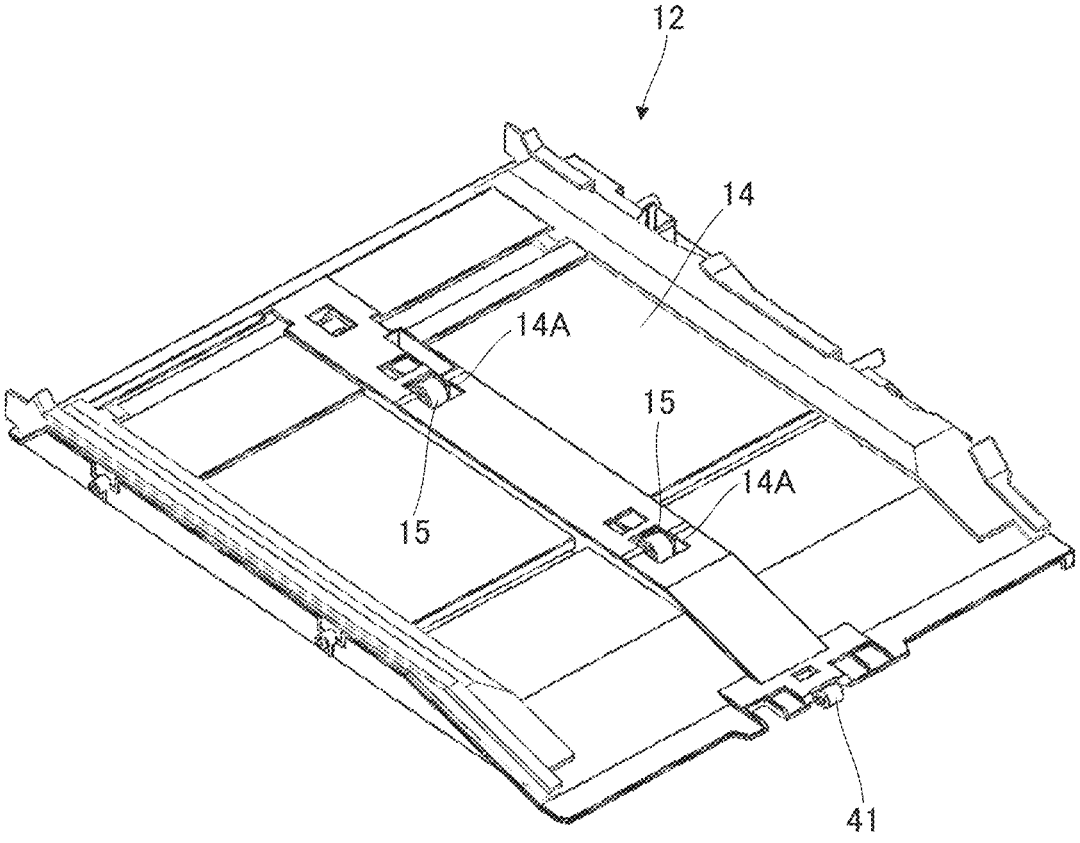
FIG. 3 is a perspective view of a multi-purpose tray of the sheet feeder according to the one embodiment as viewed from obliquely above.

Hereinafter, a description will be given of an embodiment of the present disclosure with reference to the drawings. Hereinafter, directions of rotation and right, left, upward and downward directions may be shown, but they are shown only as examples in the drawings unless otherwise stated. FIGS. 1A and 1B are perspective views showing the appearance of an image forming apparatus to which a sheet feeder according to one embodiment of the present disclosure is applied, FIG. 1A shows a state where a sidewall of an apparatus body is closed, and FIG. 1B shows a state where the sidewall of the apparatus body is halfway open. FIG. 2 is a cross-sectional view of the sheet feeder according to this embodiment. FIG. 3 is a perspective view of a multi-purpose tray of the sheet feeder as viewed from obliquely above.

As shown in FIGS. 1A, 1B, and 2, an image forming apparatus 1 is, for example, a printer. In the image forming apparatus 1, an apparatus body 2 thereof is provided at the top with a sheet output tray 3 and so on and internally provided with a sheet feeder 10 as one embodiment of the present disclosure, an image forming device (not shown), a fixing device (not shown), and so on. The sheet feeder 10 according to this embodiment is constituted by including a sheet supply cassette 11, a multi-purpose tray 12, a sheet feed device 13, and so on. The sheet supply cassette 11 is designed to accommodate a plurality of recording paper sheets P of a standard size stacked therein. The multi-purpose tray 12 is designed to lay at least one recording paper sheet P of a standard size or a non-standard size thereon. The sheet feed device 13 pulls out a recording paper sheet P from the sheet supply cassette 11 or the multi-purpose tray 12 and conveys and feeds it.

The image forming device forms an image shown by image data, based on an electrophotographic process using a toner, on the recording paper sheet P pulled out and fed from the sheet supply cassette 11 or the multi-purpose tray 12 by the sheet feed device 13 of the sheet feeder 10. The recording paper sheet with an image formed thereon is subjected to fixation processing of the fixing device and then ejected to the sheet output tray 3.

A sidewall 2A of the apparatus body 2 of the image forming apparatus 1 is supported on the apparatus body 2 by a pin 2B provided at a lower end portion of one side surface of the sidewall 2A and is movable to open and close with respect to the apparatus body 2 by the pin 2B.

When the sidewall 2A is opened, an opening 2D leading to the interior of the apparatus body 2 becomes open. The sidewall 2A is made open in an inclined position where its end close to the apparatus body 2 is located lower than the other end. A recording paper sheet P is placed on the upper surface of the opened and inclined sidewall 2A and introduced from the sidewall 2A onto the multi-purpose tray 12.

As shown in FIGS. 2 and 3, the multi-purpose tray 12 includes: an approximately tabular guide plate 14 on which a recording paper sheet P for manual feed is to be placed; two driven rollers 15 projecting out of different openings 14A in the guide plate 14 and supported rotatably by the guide plate 14; and respective conveyance rollers 16 pressed against the peripheral surfaces of the two driven rollers 15. The conveyance rollers 16 are timely driven into counterclockwise rotation.

A recording paper sheet P for conveyance through manual feed is inserted from the sidewall 2A by the user and thus placed on the multi-purpose tray 12. The placed recording paper sheet P is introduced from the sidewall 2A to a conveyance path 17 on the multi-purpose tray 12, inserted between the driven rollers 15 and the conveyance rollers 16, and conveyed via a distal end of the multi-purpose tray 12 to the sheet feed device 13 by counterclockwise rotation of the conveyance rollers 16 in FIG. 2.

Figure 4A:
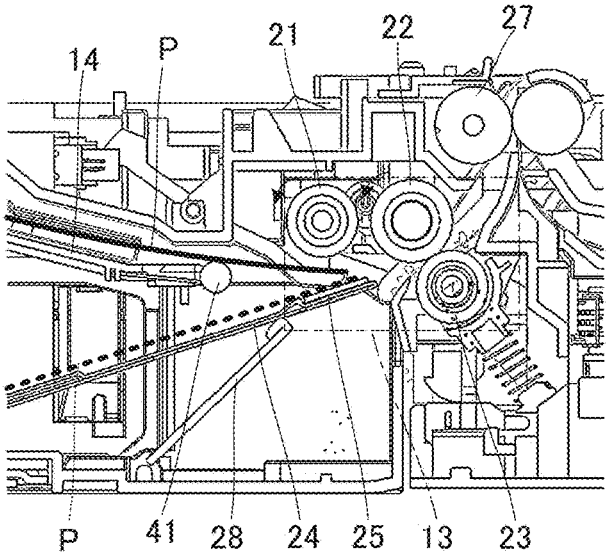
FIG. 4A is an enlarged cross-sectional view of a sheet feed device of the sheet feeder according to the one embodiment and its surrounding portion and shows a state where a pick-up roller of the sheet feed device is away from a separating pad.
Figure 4B:
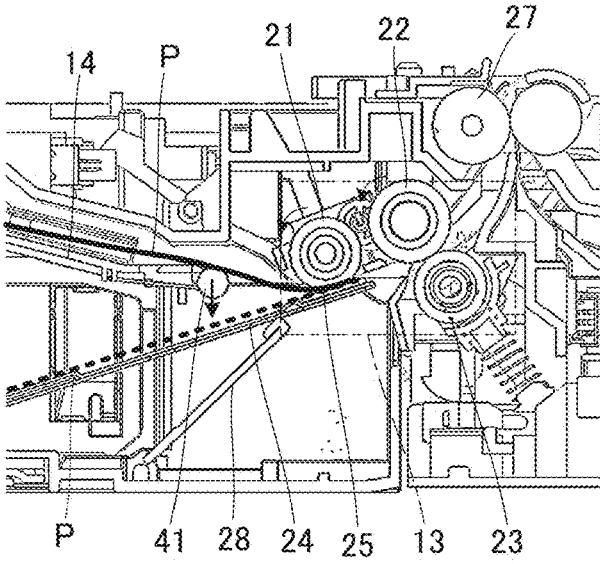
FIG. 4B is an enlarged cross-sectional view of the sheet feed device of the sheet feeder according to the one embodiment and its surrounding portion and shows a state where the pick-up roller is pressed against a leading end portion of a recording paper sheet conveyed from the multi-purpose tray.
Figure 4C:
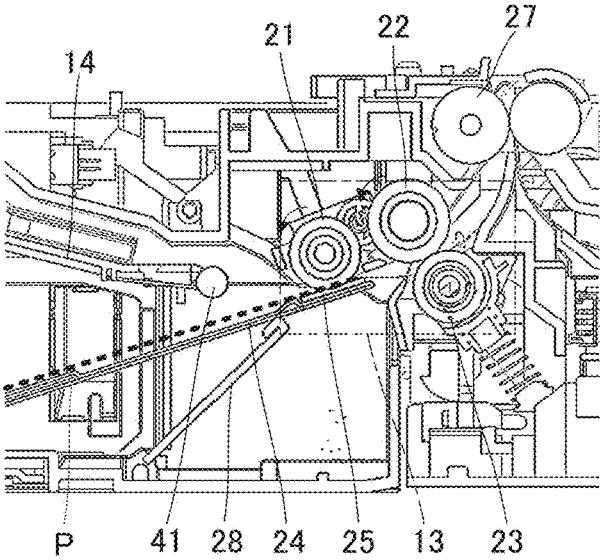
FIG. 4C is an enlarged cross-sectional view of the sheet feed device of the sheet feeder according to the one embodiment and its surrounding portion and shows a state where the pick-up roller is pressed against a leading end portion of a recording paper sheet in a sheet supply cassette.

FIGS. 4A, 4B, and 4C are enlarged cross-sectional views of the sheet feed device 13 of the sheet feeder 10 and its surrounding portion. As shown in FIGS. 4A, 4B, and 4C, the sheet feed device 13 includes: a pick-up roller 21 that pulls out a recording paper sheet P from the sheet supply cassette 11 or the multi-purpose tray 12; a feed roller 22 that conveys the recording paper sheet P; and a retard roller 23 abutting on a lower side of the peripheral surface of the feed roller 22.

The sheet supply cassette 11 is internally provided with a tray 24 on which a stack of recording paper sheets P are to be placed, and a separating pad 25 is fixed on a distal end portion of the upper surface of the tray 24. An innermost end of the tray 24 is supported, pivotally about a pin provided at the innermost end thereof, on the inside surface of the sheet supply cassette 11 to allow the distal end of the tray 24 to move up and down (in directions toward and away from the pick-up roller 21). An arm 28 is provided under the tray 24. A lower end of the arm 28 is supported pivotally about a pin provided at the lower end thereof to allow its upper end to move up and down. When the arm 28 is pivotally moved upward by an unshown mechanism and the upper end (the distal end) of the arm 28 thus lifts the tray 24 from below, the tray 24 pivotally moves about the pin located at the innermost end thereof, the distal end of the tray 24 moves close to the pick-up roller 21, and the tray 24 thus becomes inclined.

Figure 5A:
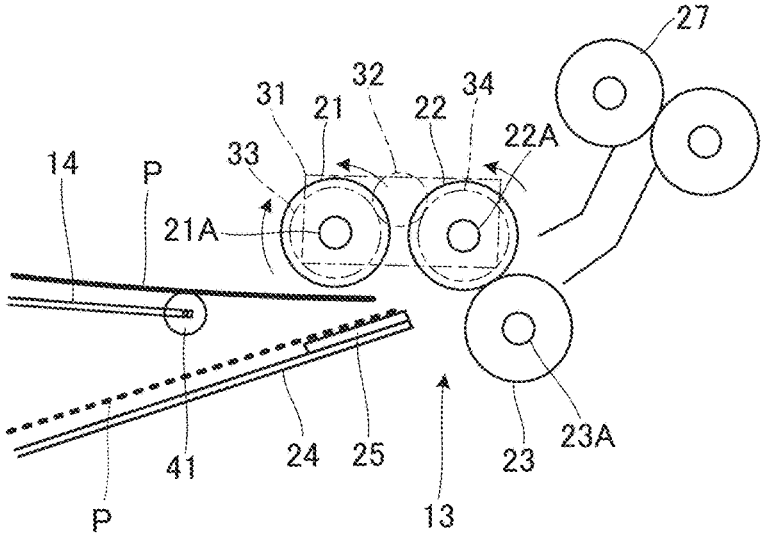
FIG. 5A is an enlarged view schematically showing the sheet feed device of the sheet feeder according to the one embodiment and its surrounding portion and shows a state where the pick-up roller of the sheet feed device is away from the separating pad.
Figure 5B:
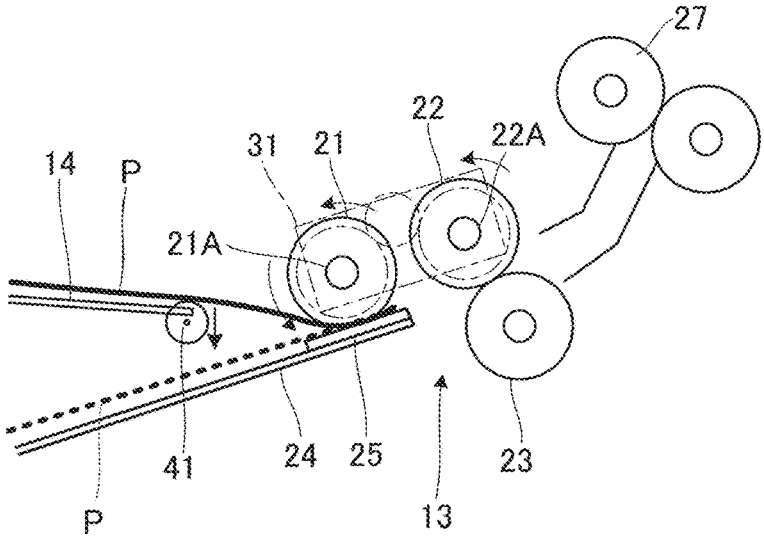
FIG. 5B is an enlarged view schematically showing the sheet feed device of the sheet feeder according to the one embodiment and its surrounding portion and shows a state where the pick-up roller is pressed against a leading end portion of a recording paper sheet conveyed from the multi-purpose tray.
Figure 5C:
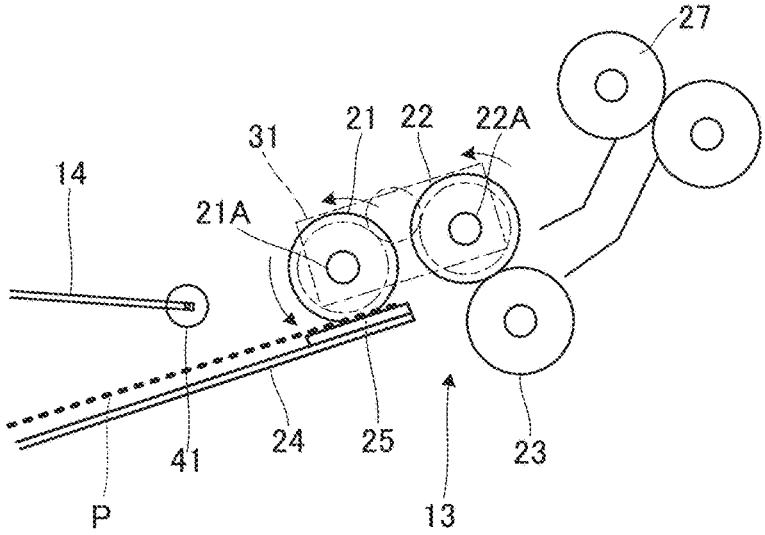
FIG. 5C is an enlarged view schematically showing the sheet feed device of the sheet feeder according to the one embodiment and its surrounding portion and shows a state where the pick-up roller is pressed against a leading end portion of a recording paper sheet in the sheet supply cassette.

FIGS. 5A, 5B, and 5C are views showing the sheet feed device 13 of the sheet feeder 10 and its surrounding portion. As shown in FIG. 5A, a shaft 21A of the pick-up roller 21 and a shaft 22A of the feed roller 22 are supported rotatably about their axes by a support portion 31. Furthermore, a shaft (not shown) of a gear 32 is also rotatably supported by the support portion 31. A gear 33 is fixed to the shaft 21A of the pick-up roller 21, a gear 34 is fixed to the shaft 22A of the feed roller 22, and the gear 32 is meshed with the gears 33 and 34. When the shaft 22A of the feed roller 22 is driven into counterclockwise rotation, the feed roller 22 and the gear 34 rotate counterclockwise, the rotation of the gear 34 is transmitted via the gear 32 to the gear 33, and the gear 33 and the pick-up roller 21 thus rotate counterclockwise like the feed roller 22.

Furthermore, the support portion 31 is supported rotatably about the shaft 22A of the feed roller 22 on the shaft 22A and pivotally moved within a certain range of angles by an unshown mechanism. When, as shown in FIGS. 4A and 5A, the support portion 31 is pivotally moved clockwise about the shaft 22A, the pick-up roller 21 moves away from the separating pad 25 present on the distal end portion of the upper surface of the tray 24. On the other hand, when, as shown in FIGS. 4B, 4C, 5B, and 5C, the support portion 31 is pivotally moved counterclockwise about the shaft 22A, the pick-up roller 21 is pressed against the separating pad 25.

A shaft 23A of the retard roller 23 is supported rotatably at a fixed position of a frame of the sheet feeder 10. The retard roller 23 always abuts on the lower side of the peripheral surface of the feed roller 22.

On the other hand, a guide roller 41 is provided at a distal end of the guide plate 14 of the multi-purpose tray 12 and projects beyond the distal end of the guide plate 14 toward the sheet feed device 13.

Figure 6A:
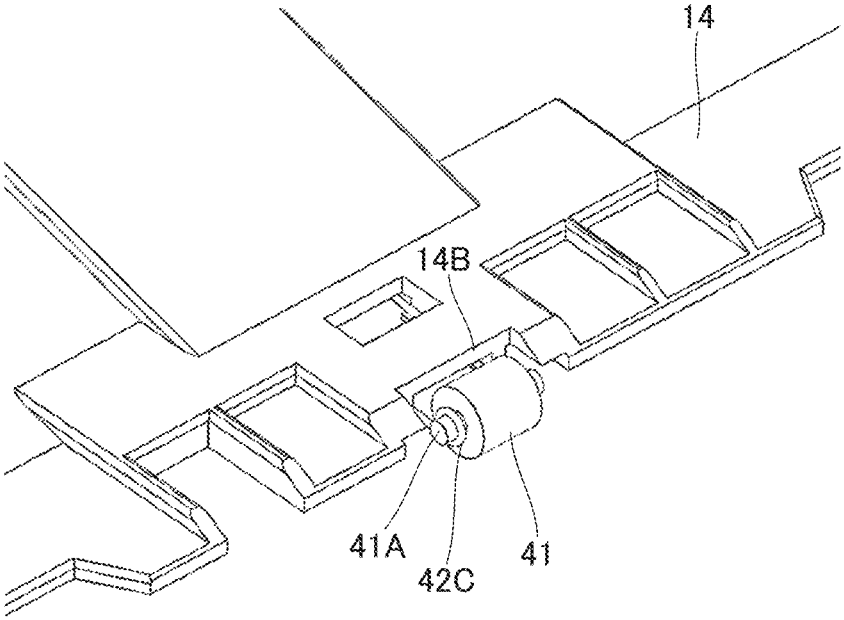
FIG. 6A is an enlarged perspective view of a guide roller provided at an end of a guide plate of the multi-purpose tray and its surrounding portion as viewed from above.
Figure 6B:
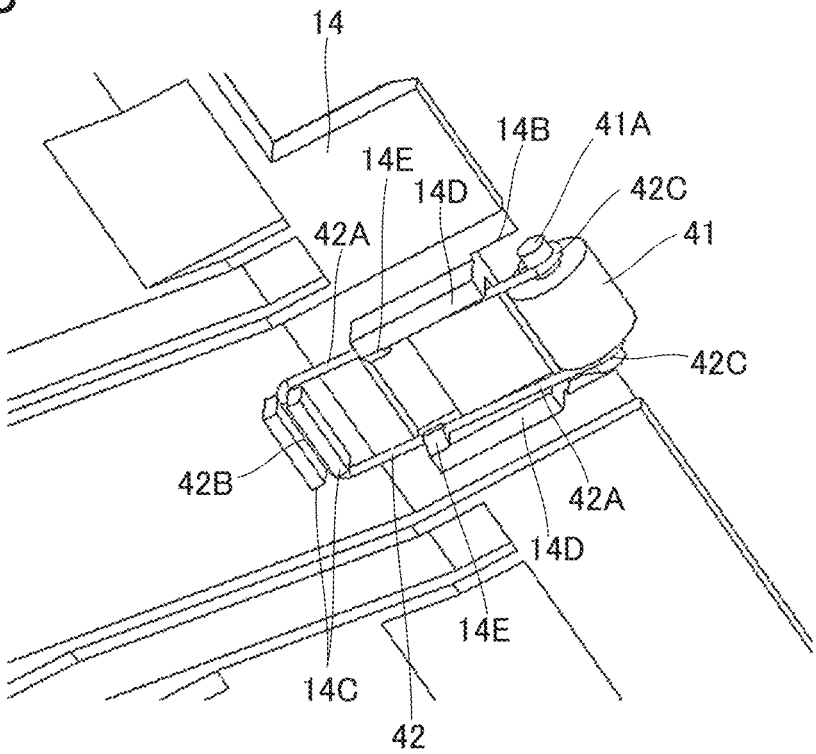
FIG. 6B is an enlarged perspective view of the guide roller and its surrounding portion as viewed from below.

FIG. 6A is an enlarged perspective view of the guide roller 41 and its surrounding portion as viewed from above and FIG. 6B is an enlarged perspective view of the guide roller 41 and its surrounding portion as viewed from below. As shown in FIGS. 6A and 6B, a rectangular cutaway 14B is formed at the distal end of the guide plate 14 of the multi-purpose tray 12, the guide roller 41 is disposed within the rectangular cutaway 14B, and the shaft 41A of the guide roller 41 is rotatably supported by a spring member 42.

The spring member 42 includes: two arms 42A; a connecting portion 42B connecting between respective root ends of the arms 42A; and respective bearings 42C formed by bending respective distal end portions of the arms 42A into loops.

The connecting portion 42B of the spring member 42 is fitted into a groove between two raised portions 14C provided on the underside surface of the guide plate 14 of the multi-purpose tray 12, the arms 42A of the spring member 42 are passed along the respective inside surfaces of two small walls 14D provided on the underside surface of the guide plate 14 of the multi-purpose tray 12 and are engaged with respective pawls 14E formed on the inside surfaces of the small walls 14D, and, thus, the spring member 42 is seated to the distal end portion of the guide plate 14 of the multi-purpose tray 12.

Furthermore, both ends of the shaft 41A of the guide roller 41 are inserted into the respective looped bearings 42C located at the distal ends of the arms 42A of the spring member 42 and, thus, the guide roller 41 is rotatably supported by the bearings 42C.

Moreover, each of the arms 42A is elastically upwardly and downwardly deformable in a range from a portion thereof engaged with the pawl 14E of the small wall 14D to the bearing 42C located at the distal end of the arm 42A. Therefore, the guide roller 41 is supported rotatably, upwardly and downwardly movably, and elastically by the spring member 42. In other words, each arm 42A acts as an example of the elastic support member defined in CLAIMS to support the guide roller 41 elastically and movably in directions toward and away from the sheet supply cassette 11.

Suppose that, in the structure described so far, a recording paper sheet P is placed on the multi-purpose tray 12 as shown in FIGS. 4A and 5A. In conveying a recording paper sheet P for manual feed, the recording paper sheet P is conveyed through the peripheral surface of the guide roller 41 located at the distal end of the multi-purpose tray 12 to the sheet feed device 13 by the conveyance rollers 16, the leading end of the recording paper sheet P is stopped below the pick-up roller 21, and the pick-up roller 21 becomes opposed to the leading end of the recording paper sheet P. When, in this state, the support portion 31 is rotated counterclockwise about the shaft 22A as shown in FIGS. 4B and 5B, the pick-up roller 21 is pressed against the leading end portion of the recording paper sheet P present on the multi-purpose tray 12. Then, when the pick-up roller 21 and the feed roller 22 are rotated counterclockwise, the recording paper sheet P on the multi-purpose tray 12 is pulled out by the pick-up roller 21 and conveyed through between the feed roller 22 and the retard roller 23 to the conveyance roller 27.

Furthermore, as shown in FIGS. 4A, 4B, 5A, and 5B, the position of the pick-up roller 21 to be pressed against the leading end portion of the recording paper sheet P is designed as a position closer to the sheet supply cassette 11 than the upper side of the peripheral surface of the guide roller 41. In other words, there is a level difference between the upper side of the peripheral surface of the guide roller 41 and the position of the pick-up roller 21 to be pressed against the leading end portion of the recording paper sheet P. Therefore, when the pick-up roller 21 is pressed against the leading end portion of the recording paper sheet P, the recording paper sheet P inclines downward in a range from the upper side of the peripheral surface of the guide roller 41 to the position of the pick-up roller 21 pressed against the recording paper sheet P. By the recording paper sheet P inclined in the above manner, the guide roller 41 is pushed down and back against the biasing forces of the arms 42A of the spring member 42 and the arms 42A are thus elastically deformed to bend downward. Then, when the recording paper sheet P on the multi-purpose tray 12 is pulled out by the pick-up roller 21, the recording paper sheet P slides on the upper side of the peripheral surface of the guide roller 41 and, thus, the guide roller 41 rotates.

Since, in this manner, the guide roller 41 follows the downward inclination of the recording paper sheet P and is pushed down and back by the recording paper sheet P and the recording paper sheet P then slides on the upper side of the peripheral surface of the guide roller 41 to rotate the guide roller 41, the pressing force of the recording paper sheet P on the multi-purpose tray 12 is reduced and the frictional force given to the multi-purpose tray 12 by the recording paper sheet P during conveyance of the recording paper sheet P by the pick-up roller 21 is thus reduced. Therefore, the conveyance of the recording paper sheet P on the multi-purpose tray 12, the pullout of the recording paper sheet P from the multi-purpose tray 12 by the pick-up roller 21, and the conveyance of the recording paper sheet P by the feed roller 22 can be smoothly performed and, thus, the load on the pick-up roller 21 and the feed roller 22 during conveyance of the recording paper sheet P and even the load on the recording paper sheet P can be reduced.

If, in the absence of the guide roller 41, the pick-up roller 21 is pressed against the leading end portion of the recording paper sheet P, the recording paper sheet P inclines downward and comes into direct contact with the distal end of the guide plate 14 of the multi-purpose tray 12. In this case, during pullout of the recording paper sheet P on the multi-purpose tray 12 by the pick-up roller 21, the recording paper sheet P comes into direct contact with the distal end of the guide plate 14, which interferes smooth conveyance of the recording paper sheet P on the multi-purpose tray 12, smooth pullout of the recording paper sheet P by the pick-up roller 21, and smooth conveyance of the recording paper sheet P by the feed roller 22, thus increases the load on the pick-up roller 21 and the feed roller 22 and even the load on the recording paper sheet P, and makes the feed and conveyance of the recording paper sheet P unstable.

When no recording paper sheet P is placed on the multi-purpose tray 12, the pick-up roller 21 becomes opposed to the leading end of an uppermost one of recording paper sheets P on the tray 24 of the sheet supply cassette 11. When, in this state, the support portion 31 is rotated counterclockwise about the shaft 22A as shown in FIGS. 4C and 5C, the pick-up roller 21 is pressed against the leading end portion of the uppermost recording paper sheet P on the tray 24. Then, when the pick-up roller 21 and the feed roller 22 are rotated counterclockwise, the uppermost recording paper sheet P on the tray 24 is pulled out by the pick-up roller 21 and conveyed through between the feed roller 22 and the retard roller 23 to the conveyance roller 27. The retard roller 23 has a function to prevent concurrent feed of a plurality of recording paper sheets P conveyed by the feed roller 22.

Figure 7:
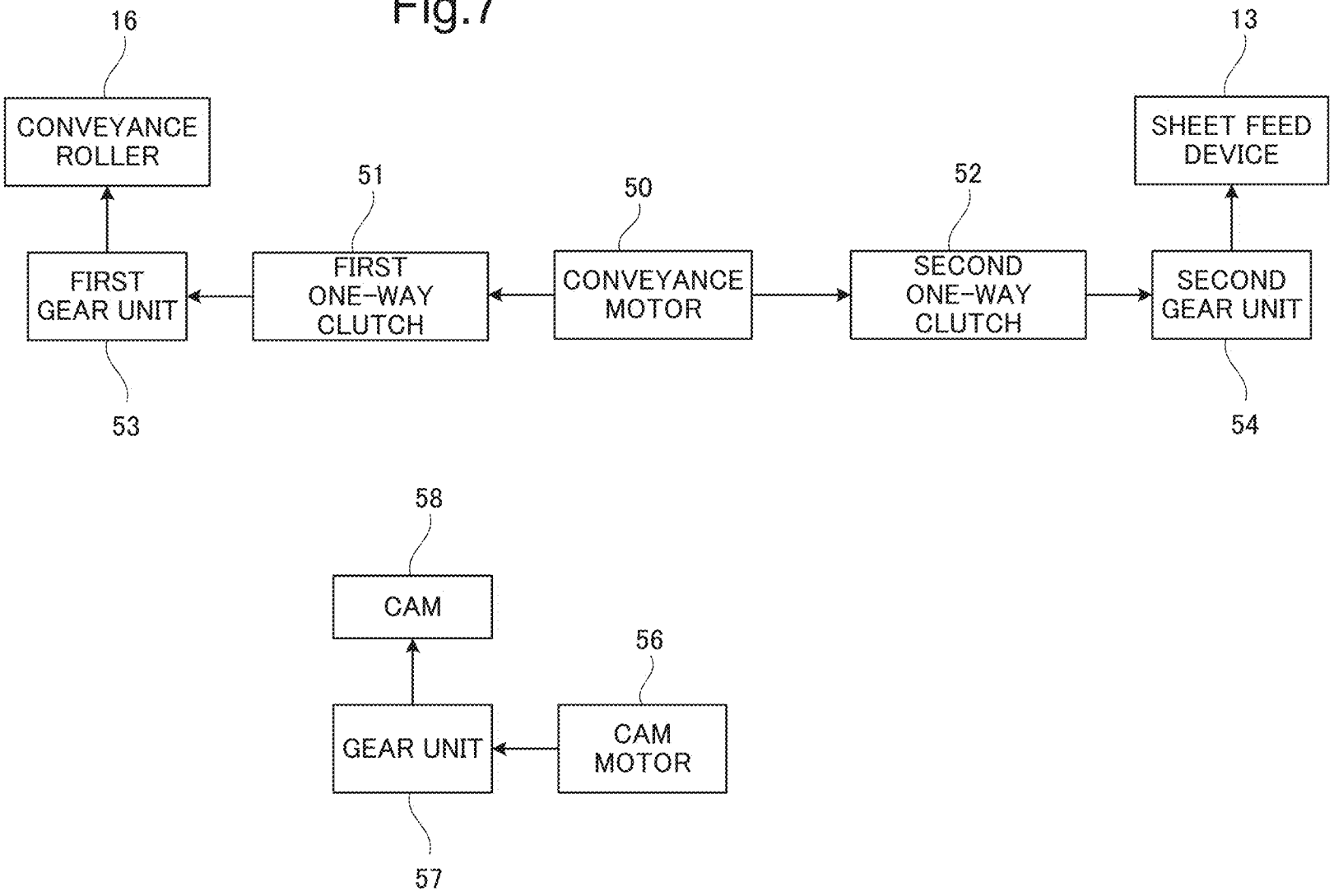
FIG. 7 is a block diagram conceptually showing an example of a drive system for conveyance rollers, a pick-up roller, and a feed roller of the sheet feeder.

Next, a description will be given of a drive system and a control system of the sheet feeder 10. FIG. 7 is a block diagram conceptually showing an example of a drive system for the conveyance rollers 16, the pick-up roller 21, and the feed roller 22 of the sheet feeder 10. As shown in FIG. 7, a drive source of the conveyance rollers 16, the pick-up roller 21, and the feed roller 22 is a single conveyance motor 50. An output shaft of the conveyance motor 50 is connected to a first one-way clutch 51 and a second one-way clutch 52. The first one-way clutch 51 and the second one-way clutch 52 correspond to the transmission device defined in CLAIMS.

The first one-way clutch 51 transmits forward rotation of the output shaft of the conveyance motor 50 to a first gear unit 53 and, in response, the first gear unit 53 rotates the conveyance rollers 16 counterclockwise in FIG. 2. Furthermore, the first one-way clutch 51 does not transmit backward rotation of the output shaft of the conveyance motor 50 to the first gear unit 53 to stop the conveyance rollers 16.

The second one-way clutch 52 transmits backward rotation of the output shaft of the conveyance motor 50 to a second gear unit 54 and, in response, the second gear unit 54 rotates the pick-up roller 21 and the feed roller 22 counterclockwise in FIG. 2. Furthermore, the second one-way clutch 52 does not transmit forward rotation of the output shaft of the conveyance motor 50 to the second gear unit 54 to stop the pick-up roller 21 and the feed roller 22.

Therefore, when the output shaft of the conveyance motor 50 is rotating forward, the conveyance rollers 16 are rotating counterclockwise in FIG. 2 and the pick-up roller 21 and the feed roller 22 are stopping. On the other hand, when the output shaft of the conveyance motor 50 is rotating backward, the pick-up roller 21 and the feed roller 22 are rotating counterclockwise in FIG. 2 and the conveyance rollers 16 are stopping. Thus, with the use of a single conveyance motor 50, the rotation of the conveyance rollers 16 and the rotation of the pick-up roller 21 and the feed roller 22 can be driven separately from each other.

Furthermore, as described previously, the support portion 31 supports the shaft 21A of the pick-up roller 21, the shaft 22A of the feed roller 22, and the shaft of the gear 34, is supported rotatably about the shaft 22A of the feed roller 22 by the shaft 22A, and is pivotally moved within a certain range of angles. When, as shown in FIGS. 4A and 5A, the support portion 31 is pivotally moved clockwise about the shaft 22A, the pick-up roller 21 moves away from the separating pad 25 present on the distal end portion of the upper surface of the tray 24. On the other hand, when, as shown in FIGS. 4B and 5B, the support portion 31 is pivotally moved counterclockwise about the shaft 22A, the pick-up roller 21 is pressed against the separating pad 25. For example, the support portion 31 is pivotally moved counterclockwise about the shaft 22A by a biasing force of an unshown spring and, thus, the pick-up roller 21 is pressed against the separating pad 25. On the other hand, the support portion 31 is pivotally moved clockwise about the shaft 22A against the biasing force of the spring by a mechanism including a cam and, thus, the pick-up roller 21 moves away from the separating pad 25. As shown in FIG. 7, a cam motor 56 and a gear unit 57 are provided in order to rotate the cam 58 and the angle of rotation of the cam motor 56 is controlled to press the pick-up roller 21 against the separating pad 25 by the biasing force of the spring or move the pick-up roller 21 away from the separating pad 25 against the biasing force of the spring.

Figure 8:
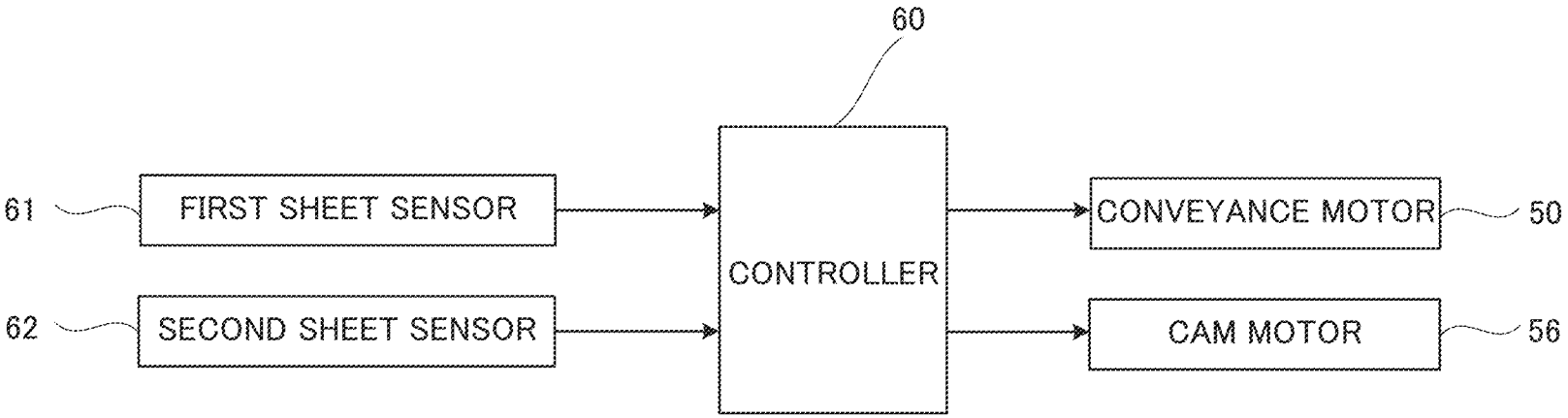
FIG. 8 is a block diagram conceptually showing an example of a control system for the sheet feeder.

FIG. 8 is a block diagram conceptually showing an example of a control system for the sheet feeder 10. As shown in FIG. 8, a controller 60 receives a detection output of a first sheet sensor 61 and a detection output of a second sheet sensor 62 and, in response, controls the drive of the conveyance motor 50 to rotate the pick-up roller 21 and the feed roller 22 and controls the drive of the cam motor 56 to allow the pick-up roller 21 to be pressed against or moved away from the separating pad 25.

The first sheet sensor 61 is provided upstream of the conveyance rollers 16 of the multi-purpose tray 12 in the direction of conveyance of a recording paper sheet P as shown in FIG. 2 and detects the leading end of the recording paper sheet P introduced into the conveyance path 17 on the multi-purpose tray 12.

The second sheet sensor 62 is provided between the guide roller 41 of the multi-purpose tray 12 and the pick-up roller 21 of the sheet feed device 13 as shown in FIG. 2 and detects the leading end of a recording paper sheet P.

In a ready state, the controller 60 stops the conveyance motor 50 to stop the conveyance rollers 16, the pick-up roller 21, and the feed roller 22, and controls the angle of rotation of the cam motor 56 and stops the cam motor 56 with the pick-up roller 21 away from the separating pad 25.

When a recording paper sheet P is introduced into the conveyance path 17 on the multi-purpose tray 12, the leading end of the recording paper sheet P is detected by the first sheet sensor 61. In response to a detection output of the first sheet sensor 61 indicating that the first sheet sensor 61 has detected the leading end of the recording paper sheet P, the controller 60 rotates the conveyance motor 50 forward to rotate the conveyance rollers 16. Therefore, when the leading end of the recording paper sheet P reaches a first one of the conveyance rollers 16, the one conveyance roller 16 conveys the recording paper sheet P. Subsequently, when the leading end of the recording paper sheet P reaches the other conveyance roller 16, the other conveyance roller 16 conveys the recording paper sheet P to the sheet feed device 13.

When the leading end of the recording paper sheet P reaches between the guide roller 41 of the multi-purpose tray 12 and the pick-up roller 21 of the sheet feed device 13, the second sheet sensor 62 detects the leading end of the recording paper sheet P. In response to a detection output of the second sheet sensor 62 indicating that the second sheet sensor 62 has detected the leading end of the recording paper sheet P, the controller 60 rotates the conveyance motor 50 a certain angle of forward rotation from the time of detection of the leading end of the recording paper sheet P by the second sheet sensor 62 and then stops the conveyance motor 50 to stop the conveyance rollers 16. Thus, the leading end of the recording paper sheet P is stopped below the pick-up roller 21 and the pick-up roller 21 becomes opposed to the leading end of the recording paper sheet P conveyed from the multi-purpose tray 12.

Subsequently, the controller 60 rotates the conveyance motor 50 backward to rotate the pick-up roller 21 and the feed roller 22. Concurrently, the controller 60 rotates the cam motor 56 to move the pick-up roller 21 toward the separating pad 25 and press the pick-up roller 21 against the leading end portion of the recording paper sheet P.

The recording paper sheet P is pulled out by the pick-up roller 21 and conveyed through between the feed roller 22 and the retard roller 23 to the conveyance roller 27.

Subsequently, the second sheet sensor 62 detects the trailing end of the recording paper sheet P. In response to a detection output of the second sheet sensor 62 indicating that the second sheet sensor 62 has detected the trailing end of the recording paper sheet P, the controller 60 rotates the conveyance motor 50 backward for a certain period of time from the time of detection of the trailing end of the recording paper sheet P by the second sheet sensor 62, then stops the conveyance motor 50 to stop the conveyance rollers 16, the pick-up roller 21, and the feed roller 22, controls the angle of rotation of the cam motor 56 to move the pick-up roller 21 away from the separating pad 25, and stops the cam motor 56 to return to the ready state.

As thus far described, in this embodiment, the guide roller 41 is provided at the distal end of the multi-purpose tray 12 and supported elastically and movably in upward and downward directions by the spring member 42. In pulling out a recording paper sheet P on the multi-purpose tray 12 by the pick-up roller 21, the guide roller 41 is pushed down and back against the biasing forces of the arms 42A of the spring member 42 by the recording paper sheet P and the recording paper sheet P slides on the upper side of the peripheral surface of the guide roller 41 to rotate the guide roller 41. Thus, the conveyance of the recording paper sheet P on the multi-purpose tray 12, the pullout of the recording paper sheet P by the pick-up roller 21, and the conveyance of the recording paper sheet P by the feed roller 22 can be smoothly performed and the load on the recording paper sheet P and the load on the pick-up roller 21 and the feed roller 22 can be reduced.

Since, in the sheet conveying device disclosed in BACKGROUND, the manual feed unit is mounted over the sheet supply cassette, a large level difference is present between the manual feed conveyance path and the cassette conveyance path at the point of merge between them, a sheet is conveyed from the manual feed unit to the sheet feed unit while being largely bent and the sheet comes into hard contact with a guide located at the distal end of the manual feed unit, which invites a problem in that the load of sheet conveyance by the sheet feed unit increases and the feed and conveyance of the sheet become unstable.

Unlike the conventional sheet conveying device, in the above embodiment, in pulling out a sheet from the multi-purpose tray and conveying it, the load of conveyance of the sheet can be reduced as described above.

Although in the above embodiment the printer is taken as an example of the image forming apparatus according to the present disclosure, it is merely illustrative and the image forming apparatus according to the present disclosure may be a multifunction peripheral, a copier, a facsimile machine or other types of image forming apparatuses.

The structure of the above embodiment described with reference to FIGS. 1 to 8 is merely illustrative of the present disclosure and is not intended to limit the present disclosure to the above structure.

While the present disclosure has been described in detail with reference to the embodiments thereof, it would be apparent to those skilled in the art that the various changes and modifications may be made therein within the scope defined by the appended claims.

What is claimed is:

1. A sheet feeder comprising:

a sheet supply cassette that supplies a sheet accommodated therein;

a multi-purpose tray provided above the sheet supply cassette and with cutaway formed at one end on a downstream side in a sheet feed direction;

a guide roller provided within the cutaway to come into contact with the sheet placed on an upper surface of the multi-purpose tray;

elastically deformable arms with respective one end having a bearing supporting a shaft of the guide roller and with respective the other end fixed to a lower surface of the multi-purpose tray; and a pick-up roller that is disposed apart from the one end of the multi-purpose tray to downstream side in a sheet feed direction, is movable in a vertical direction, and, when moved downward, pulls out the sheet while pressing a leading end portion of the sheet, which protruding from the one end of the multi-purpose tray and across an upper side of a peripheral surface of the guide roller, on the sheet supply cassette, wherein a position of the pick-up roller pressing the leading end portion of the sheet is located below the upper side of the peripheral surface of the guide roller.

2. The sheet feeder according to claim 1, further comprising a conveyance roller provided at the upper surface of the multi-purpose tray to convey the sheet on the multi-purpose tray in a direction toward the one end of the multi-purpose tray, wherein the conveyance roller conveys the sheet to the position where the leading end portion of the sheet to be pressed by the pick-up roller.

3. The sheet feeder according to claim 1, wherein when moved downward, the pick-up roller presses the leading end portion of the sheet conveyed through the upper side of the peripheral surface of the guide roller and pulls out the sheet from the multi-purpose tray or the pick-up roller presses a leading end portion of a sheet accommodated in the sheet supply cassette and pulls out the sheet from the sheet supply cassette.

4. The sheet feeder according to claim 3, wherein when the pick-up roller is moved downward and presses the leading end portion of the sheet conveyed through the upper side of the peripheral surface of the guide roller, the guide roller is moved from the multi-purpose tray toward the sheet supply cassette by deformation of the arms.

5. The sheet feeder according to claim 2, further comprising:

a drive source that rotates the conveyance roller and the pick-up roller separately from each other; and a transmission device that transmits a driving force of the drive source selectively to the conveyance roller or to the pick-up roller.

6. An image forming apparatus comprising:

the sheet feeder according to claim 1; and an image forming device that forms an image on a sheet pulled out and fed from the multi-purpose tray or the sheet supply cassette of the sheet feeder.

* * * * *